US006698550B2

(12) United States Patent
Crain

(10) Patent No.: US 6,698,550 B2
(45) Date of Patent: Mar. 2, 2004

(54) ADJUSTABLE STEP LADDER

(76) Inventor: Vernon Crain, 245 SW. Wallula Ave., Gresham, OR (US) 97080

( * ) Notice: Subject to any disclaimer, the term of this patent is extended or adjusted under 35 U.S.C. 154(b) by 141 days.

(21) Appl. No.: 10/117,203

(22) Filed: Apr. 4, 2002

(65) Prior Publication Data

US 2003/0188926 A1 Oct. 9, 2003

(51) Int. Cl.[7] ..... E06C 1/00; E06C 7/00
(52) U.S. Cl. ..... 182/166; 182/201
(58) Field of Search ..... 182/166, 165, 182/200–204, 209, 22, 23, 194

(56) References Cited

U.S. PATENT DOCUMENTS 2,899,008 A * 8/1959 Larson ..... 182/23 X
4,155,422 A * 5/1979 Larson et al. ..... 182/166 X
4,371,055 A * 2/1983 Ashton et al. ..... 182/23 X
4,951,780 A * 8/1990 Kim ..... 182/167 X
5,074,377 A * 12/1991 Krause ..... 182/209 X
5,944,142 A * 8/1999 Milner ..... 182/203
6,073,726 A 6/2000 McCrystal
6,193,013 B1 * 2/2001 Milner ..... 182/203
6,220,389 B1 * 4/2001 Krause ..... 182/23

* cited by examiner

*Primary Examiner*—Hugh B. Thompson
(74) *Attorney, Agent, or Firm*—Chernoff, Vilhauer, McClung & Stenzel, LLP

(57) ABSTRACT

An adjustable back leg assembly provides a step ladder of simple construction for convenient use on stairs and other sloping surfaces.

4 Claims, 4 Drawing Sheets

ADJUSTABLE STEP LADDER

CROSS-REFERENCE TO RELATED APPLICATIONS

Not applicable.

BACKGROUND OF THE INVENTION

The present invention relates to a ladder and, more particularly, to a step ladder adjustable to facilitate use on sloping surfaces.

Step ladders are widely used for tasks such as painting, wiring, and grounds maintenance. Often the surface on which the ladder is to be supported is sloping in, at least, one plane. For example, one common problem encountered by ladder users is reaching a ceiling over a stair. While each step of the stair is horizontal and flat, the slope between successive steps makes the use of a step ladder, with its four spaced apart points of support, impractical or unsafe.

McCrystal, U.S. Pat. No. 6,073,726 discloses a step ladder with adjustable stiles and back legs to facilitate use of the ladder on sloping surfaces. Each of the stiles and back legs of the step ladder can be independently adjusted to facilitate use of the ladder on surfaces that slope in more than one direction. Since the lengths of the stiles or step supporting rails are adjustable, the positions on the stiles of several steps can be adjusted to make the ladder easier to use. While step ladders with individually adjustable legs are very flexible and can be used on uneven surfaces, such ladders are relatively complicated and difficult to use. To set the ladder up on a sloping surface, the ladder must be balanced on one or more points of support while the user independently adjusts the lengths of two or more legs. A latching mechanism is required for each of the legs and for each end of each of the independently adjustable steps or treads, increasing the complexity, cost, and weight of the ladder.

What is desired, therefore, is a step ladder that is of uncomplicated construction and that is easy to set up and use on stairs or other surfaces that slope in a single direction.

DETAILED DESCRIPTION OF THE INVENTION

Figure 1:
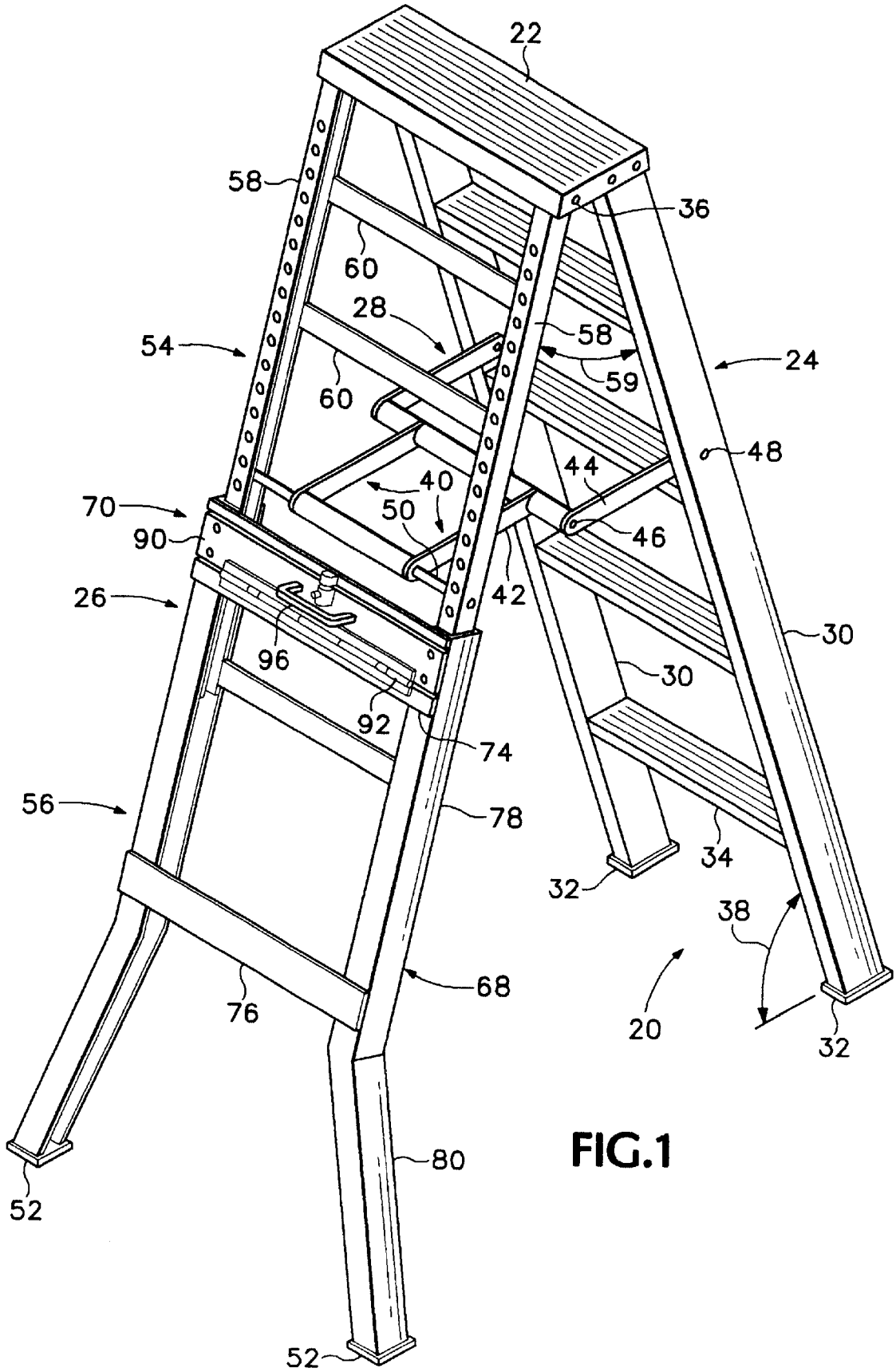
FIG. 1 is a perspective view of an adjustable step ladder.

Referring in detail to the drawings wherein similar parts of the invention are identified by like reference numerals and referring specifically to FIG. 1, the adjustable step ladder 20 comprises generally a top cap 22, a ladder element 24, a back leg assembly 26, and a spreader 28. The ladder element 24 includes a pair of spaced apart step supporting rails or stiles 30 that are fixed to the top cap 22 at one end. Feet 32, attached to the other end of the stiles 30, engage the surface supporting the stiles. A plurality of steps or treads 34 are spaced at substantially even increments along the stiles 30 and fixed to the stiles at each end of the tread. The back leg assembly 26 is attached to the top cap 22 by a top cap hinge 36 that permits the back leg assembly to be pivoted toward the ladder element 24 to a position substantially coextensive with the ladder element to minimize the size of the step ladder 20 for moving and storage. To use the step ladder 20, the back leg assembly 26 is pivoted away from the ladder element 24 to a bracing position as illustrated in FIG. 1. During use, the back leg assembly 26 braces the ladder element 24 at a ladder angle 38 to form a self supporting triangular structure in conjunction with the surface supporting the ladder. The spreader 28 prevents the back leg assembly 26 from pivoting toward the ladder element 24 while the ladder is in use.

The spreader 28 is typically an over-center linkage connecting the ladder element 24 and the back leg assembly 26. The spreader 28 comprises a pair of spreader beams 40, each comprising a pair of spreader bars 42 and 44 centrally hinged to each other by a spreader hinge pin 46. The second end of one spreader bar 44 of each spreader beam 40 is pivotally connected 48 to one of the stiles 30 of the ladder element 24. The second end of the second spreader bar 42 of each spreader beam 40 is pivotally connected to the back leg assembly 26 by a hinge bar 50.

To fold the step ladder 20 for moving or storage, the user lifts the spreader hinge pin 46 and thereby the central hinged ends of the spreader bars 42 and 44. As the center of the spreader 28 is lifted, the spreader beams 40 fold at the central hinge pin 46 and the spreader bars 42, 44 rotate about the pivotal connections at the stiles 30 and back leg assembly 26, respectively. The back leg assembly 26 pivots about the top cap hinge 36 to fold to a position substantially coextensive with the stiles 30 of the ladder element 24. To use the step ladder 20, the user pulls the back leg assembly 26 away from the ladder element 24. As the back leg assembly 26 pivots about the top cap hinge 36, the folded spreader beams 40 straighten and extend. When the spreader beams 40 are fully extended, the user pushes the spreader hinge pin 46 down to an over-center position, below a line connecting the spreader beam connections 48 and 50 at the stiles 30 and the back leg assembly 26 where a stop (not illustrated) prevents further movement of the hinge pin. The weight of the ladder and the user will urge the ladder element 24 to pivot toward the back leg assembly 26 which, in turn, will urge folding of the spreader beams 40. However, the spreader beams 40 are prevented from folding downward by the stop and are prevented from folding upward because the spreader hinge pin 46 is in the over-center position. The back leg assembly 26 is secured in the bracing position at a bracing angle 59 to the ladder element 24.

The step ladder 20 engages the supporting surface at four points; the two ladder element feet 32 at the ends of the stiles 30 and a pair of back feet 52 attached to the back leg assembly 26. When the step ladder 20 is set up for use, the ladder element 24, and the back leg assembly 26, in conjunction with the supporting surface, form a self-supporting triangle with the ladder element inclined at a ladder angle 38 to the supporting surface. When the surface is level, the feet 32 at the ends of the stiles 30 are at the same elevation as the back feet 52 and the center of the combined mass of the step ladder 20 and the user will be located approximately midway between the ladder element feet 32 and the back feet 52. In this condition, the step ladder 20 is stable. However, on a stair or other surface that slopes toward or away from the back feet 52, the ladder element 24 will pivot about the ends of the stiles 30 and the ladder angle 38 will decrease (the ladder element becomes more horizontal) or increase (the ladder element becomes more vertical), respectively. As a result, the combined center of mass of the step ladder 20 and the user will be shifted nearer the points of support for the ladder, either feet 32 or feet 52, and the ladder will become less stable. As the user climbs the ladder or moves while performing work, the combined center of mass may move outside the points supporting the step ladder causing the ladder to topple. The present inventor realized that a step ladder could be used on stairs or other sloping surfaces if the length of the back leg assembly 26 could be adjusted, as appropriate, to maintain the ladder angle 38 within a prescribed, useable range. Further, the inventor realized for many commonly encountered situations, such as a stair, the supporting surface is level in one direction and that use of the ladder can be facilitated by limiting the number of adjustments to those necessary to accommodate surfaces sloping in a single direction.

Figure 2A:
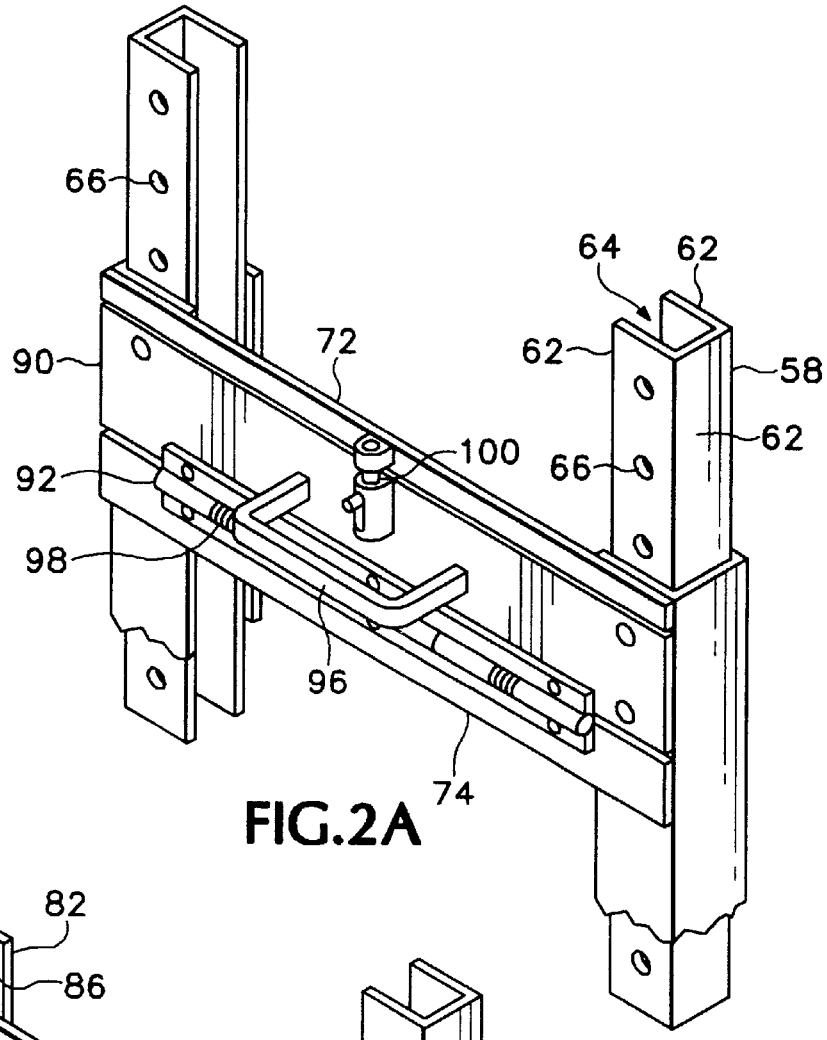
FIG. 2A is a perspective view of a back leg lock for the adjustable step ladder of FIG. 1 illustrating a locked condition.
Figure 2B:
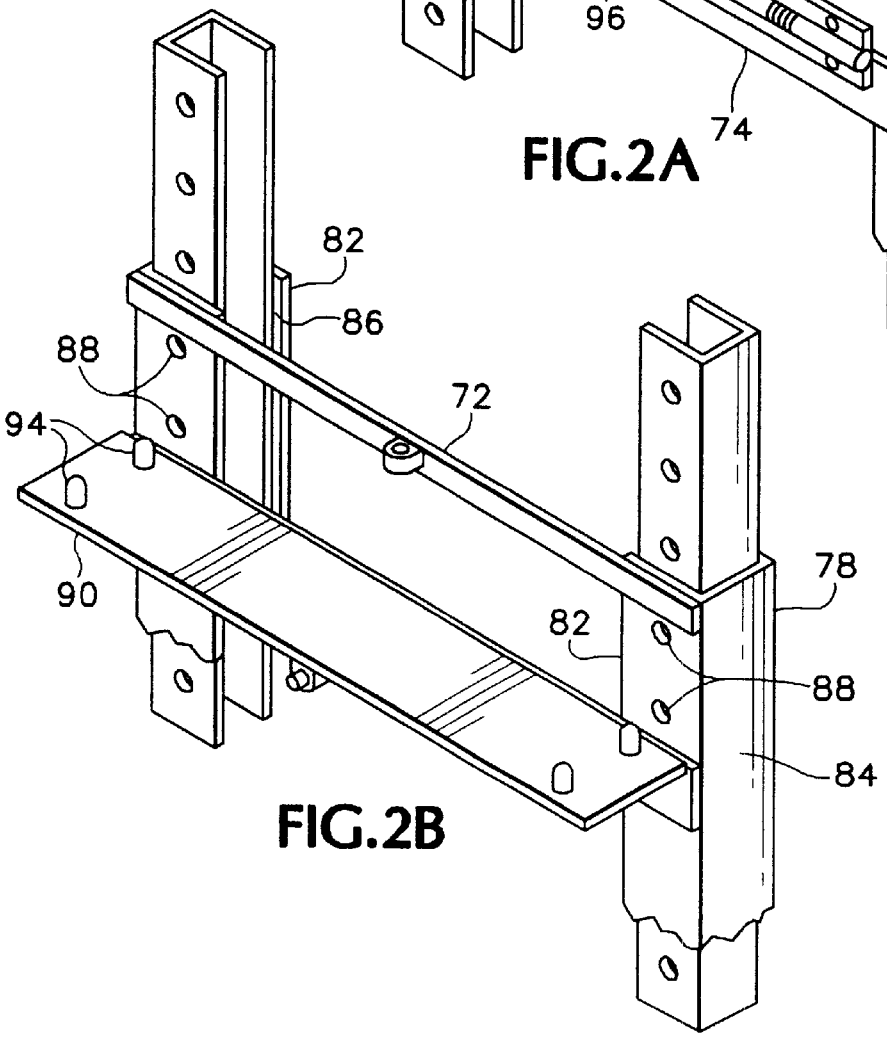
FIG. 2B is a perspective view of the back leg lock of FIG. 2A illustrating an unlocked condition.
Figure 3:
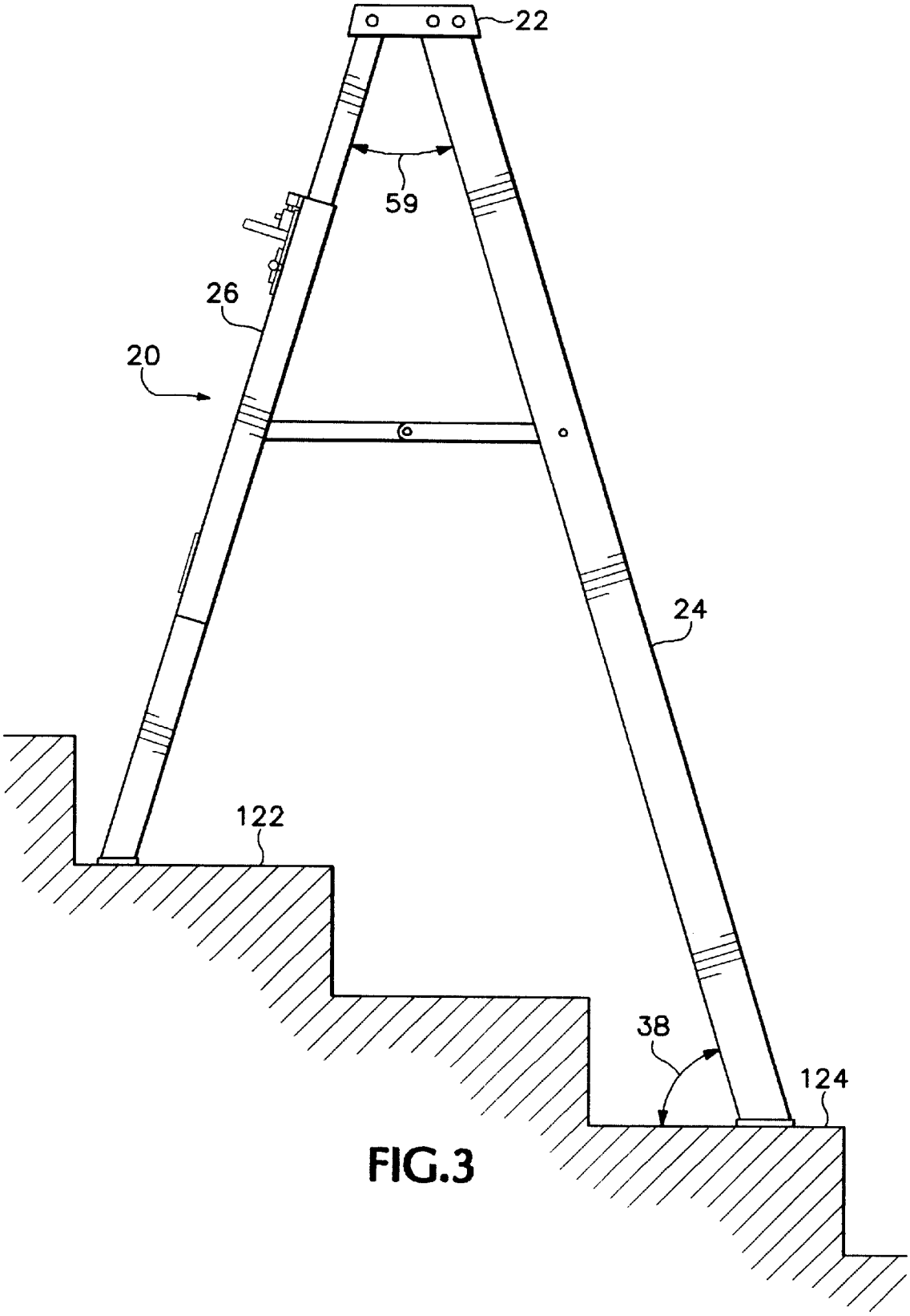
FIG. 3 is an elevation view of an adjustable step ladder on a surface sloping upward toward the back legs of the ladder.
Figure 4:
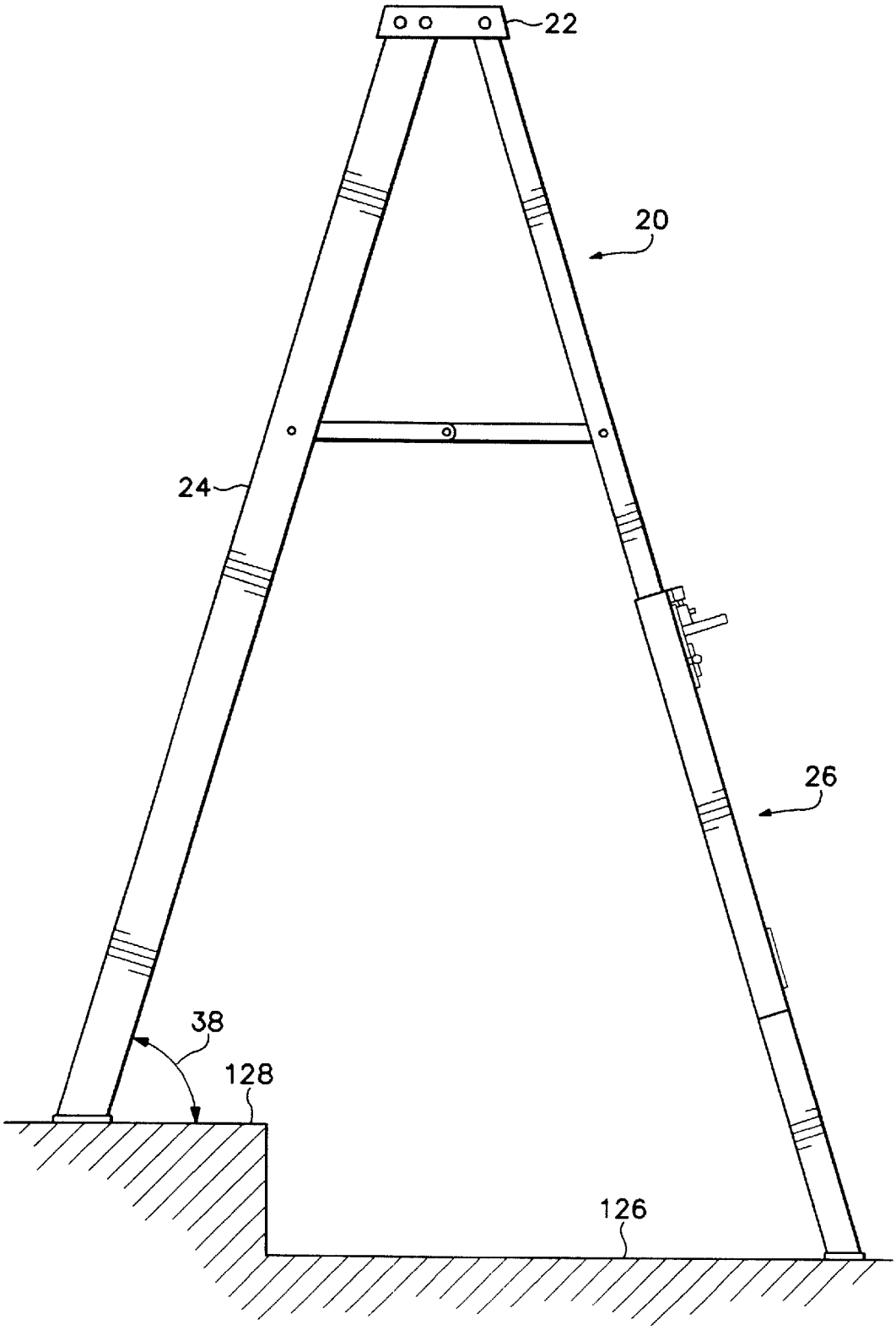
FIG. 4 is an elevation view of an adjustable step ladder on a surface sloping downward toward the back legs of the ladder.

Referring to FIGS. 3 and 4, to permit the step ladder 20 to be used when the surfaces supporting the back leg 26 and the ladder element 24 are at differing elevations, the length of the back leg assembly of the step ladder 20 is adjustable. The back leg assembly 26 comprises an upper back leg assembly 54 and a lower back leg assembly 56 that is affixed to the back feet 52. The upper back leg assembly 54 comprises a pair of channels 58 arranged generally parallel to each other and pivotally connected to the top cap 22 by the top cap hinge 36. The spreader beams 40 controlling the angular position of the back leg assembly 26 and the ladder element 24 are pivotally connected to the channels 58 of the upper back leg 54 and, when extended, maintain a bracing angle 59 appropriate for ladder stability between the back leg assembly 26 and the ladder element 24. As illustrated in FIGS. 2A and 2B, the channels 58 of the upper back leg assembly 54 have a generally C-shaped cross-section with a pair of spaced apart channel legs 60 fixed to a channel base 62 forming the throat 64 of the channel. The channels 58 are attached to the top cap 22 such that the channel bases 62 are toward the outer edges of the ladder and the throats 64 face each other. A plurality of upper channel crossmembers 60 connect the two upper back leg channels 58 to maintain the substantially parallel alignment. One leg 60 of each of the upper channels 58 includes portions defining a plurality of spaced apart apertures 66.

The lower back leg assembly 56 comprises a pair of spaced apart, lower back legs 68 and a back leg lock 70. The spaced apart relationship of the lower back legs 68 is maintained by a latch plate 72 and a crosshead 74 affixed at the upper ends of the lower back legs 68 and one or more crossmembers 76 that are affixed between the lower back legs along their length. The lower back legs 68 comprise a first section 78 and a second section 80. The first sections 78 of the lower back legs 68 have a generally C-shaped cross-section with a pair of spaced apart channel legs 82 affixed to a channel base 84 and forming the throat 86 for the channel. The lower back legs 68 are attached such that the channel bases 84 of the first sections 78 face the outer edges of the ladder 20 and the throats 88 face each other. The first sections 78 of the lower back legs 68 are arranged substantially parallel and are spaced apart so that they slidably engage the channels 58 of the upper back legs 54. Portions of the first sections of lower back legs 78 define a plurality of spaced apertures 88. The second sections 80 of the lower back legs 68 project at an angle from the first sections 78 to spread the points of support for the ladder and increase its lateral stability. The second section 80 of each of the interconnected lower back legs 68 terminates in a back foot 52 that contacts the surface against which the back leg assembly 26 braces the ladder element 24.

Referring to FIG. 3, when the back leg supporting surface 122 is at a higher elevation than the ladder element supporting surface 124 the length of the back leg assembly 26 can be shortened to maintain the ladder element 24 at a ladder angle 38 within a range that provides good stability. On the other hand, if the back leg supporting surface 126 is at a lower elevation than the ladder element supporting surface 128, as illustrated in FIG. 4, the length of the back leg assembly 26 can be extended to maintain the ladder angle 38 within the useable range.

To adjust the length of the back leg assembly 26, the user unlocks the upper 54 and lower 56 back legs and slides the upper back leg in the lower back leg until the ladder element 24 is at the correct ladder angle 38. The upper 54 and lower 56 back legs are locked together to maintain the correct length of the back leg assembly 26 during use of the step ladder 20. The back leg assembly 26 includes a lock to selectively permit or prevent the upper back leg channels 58 from sliding in the lower back leg channels 78. A lock plate 90 is hinged 92 to the crosshead 74 that secures the upper ends of the lower back legs 56. A plurality of pins 94 are affixed to the lock plate 90 and arranged to align with the plurality of apertures 88 in a leg 82 of each of the lower back leg channels 78. A handle 96 attached to the lock plate 90 facilitates pivoting of the spring loaded, hinged lock plate 90 by the user. When setting up the ladder on a sloping surface, the user grasps the handle 96 and pivots the lock plate 90 to disengage the lock pins 94 from apertures 66 in the upper back legs 58 that are co-located with the apertures 88 in the lower back legs 78. The upper back leg channels 58 can then be slid in or out of the lower back leg channels 78 until the ladder element 24 is at an appropriate ladder angle 38 and apertures 66 in the upper back leg channels 58 are in alignment with the apertures 88 in the lower back leg channels 78. The user then pivots the lock plate 90 toward the lower back leg channels 78 to engage the pins 94, with the co-located apertures 88, 66 and lock the back leg assembly 26 against further change in length. A spring in the hinge 98 urges the lock plate 90 to pivot to an engaged position and maintains engagement of the pins 94 with the apertures. A bar 100 slidably engaging the lock plate 90 selectively engages the latch plate 72 to prevent the lock plate from pivoting to a disengaged position while the ladder is in use.

The distance between the top cap 22 and the back feet 52 of the step ladder 20 can be quickly and easily adjusted to promote stable use of the step ladder on stairs and other surfaces sloping toward or away from the ladder.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A step ladder comprising:

(a) a ladder element having a first end arranged to engage a ladder supporting surface and a second end;

(b) an upper back leg having a first end pivotally attached proximate said second end of said ladder element and a second end defining a length, said upper back leg including portions defining at least two upper back leg apertures;

(c) a lower back leg including at least two back feet arranged to engage a back leg supporting surface; said lower back leg slidably engaging said upper back leg and including portions defining at least two lower back leg apertures, said lower back leg apertures being arranged to align with a plurality of said upper back leg apertures when said lower back leg is in sliding engagement with said upper back leg; and (d) at least two interconnected pins pivotally attached to one of said upper back leg and said lower back leg, said pins pivotable between a first position engaging aligned apertures of said upper back leg and said lower back leg and a second position free of engagement with said apertures of at least one of said upper back leg and said lower back leg.

2. The step ladder of claim 1 further comprising a bar slidably attached to at least one of said lower back leg and said upper back leg, said bar slidable between a first position interfering with pivoting of said pins and a second non-interfering position.

3. A step ladder comprising:

(a) a plurality of spaced apart stiles, each stile extending between a first end and a foot arranged to engage a stile supporting surface;

(b) a plurality of spaced apart treads, each tread of said plurality having a first end affixed to one of said plurality of stiles and a second end affixed to another stile of said plurality;

(c) a top cap affixed to said plurality of stiles proximate said first ends thereof;

(d) an upper back leg pivotally attached to said top cap, said upper back leg including portions defining at least two upper back leg apertures;

(e) a first spreader beam including a first beam pivotally attached at a first end to one of said plurality of stiles and attached at a second end to a first end of a second beam by a center pivot, said second beam being pivotally attached at a second end to said back leg;

(f) a second spreader beam including a third beam pivotally attached at a first end to another stile and attached at a second end to a first end of a fourth beam by a center pivot, said fourth beam being pivotally attached at a second end to said back leg and said center pivot of said second spreader beam being affixed to said center pivot of said first spreader beam and;

(g) a lower back leg including a plurality of back feet arranged to engage a back leg supporting surface, said lower back leg slidably engaging said upper back leg such that a distance from said top cap to said plurality of back feet may be altered to adjust a ladder angle of said plurality of stiles relative to said stile supporting surface, said lower back leg including portions defining at least two lower back leg apertures arranged to align with a plurality of said upper back leg apertures when said lower back leg is in sliding engagement with said upper back leg; and (h) a lock plate pivotally attached to one of said lower back leg and said upper back leg, said lock plate including a plurality of lock pins arranged to engage aligned apertures of said upper and lower back legs, said lock plate pivotable between a first position wherein said pins are in engagement with said aligned apertures and a second position wherein said pins are free of engagement with said apertures of at least one of said upper back leg and said lower back leg.

4. The step ladder of claim 3 further comprising a bar slidably attached to at least one of said lower back leg, said upper back leg, and said lock plate, said bar slidable between a first position interfering with pivoting of said lock plate and a second non-interfering position.

* * * * *